United States Patent [19]

Harris

[11] 4,218,005

[45] Aug. 19, 1980

[54] BAFFLED VENTING OF GAS FROM A POWDER ACTUATED TOOL

[75] Inventor: Frederick J. Harris, Clinton, Conn.

[73] Assignee: Olin Corporation, New Haven, Conn.

[21] Appl. No.: 61,714

[22] Filed: Jul. 30, 1979

[51] Int. Cl.[3] ..... B25C 1/14

[52] U.S. Cl. ..... 227/10

[58] Field of Search ..... 227/9–11; 60/632–638

[56] References Cited

U.S. PATENT DOCUMENTS

| | | | |
|---|---|---|---|
| 3,066,302 | 12/1962 | De Caro et al. | 227/10 |
| 3,172,120 | 3/1965 | De Caro et al. | 227/10 |
| 3,469,757 | 9/1969 | Kuavle et al. | 227/10 |
| 3,549,074 | 12/1970 | Brunelle | 227/10 |
| 3,690,536 | 9/1972 | Bakoledis | 227/10 |
| 4,074,845 | 2/1978 | Combette et al. | 227/10 |

FOREIGN PATENT DOCUMENTS

| | | | |
|---|---|---|---|
| 2263764 | 7/1974 | Fed. Rep. of Germany | 227/10 |

*Primary Examiner*—John McQuade

*Attorney, Agent, or Firm*—William W. Jones; Paul J. Lerner

[57] ABSTRACT

The venting of fouled combustion gases from the bore of a piston-type powder actuated fastening tool is provided by forming a gas vent which defines a gas flow path extending through the piston pawl return mechanism mounting to the atmosphere. A gas chamber is provided within the pawl mounting which chamber is vented to the atmosphere. A series of baffles is disposed within the pawl mounting in the gas path to provide for cooling of the hot combustion gases.

3 Claims, 2 Drawing Figures

BAFFLED VENTING OF GAS FROM A POWDER ACTUATED TOOL

Figures 1, 2:
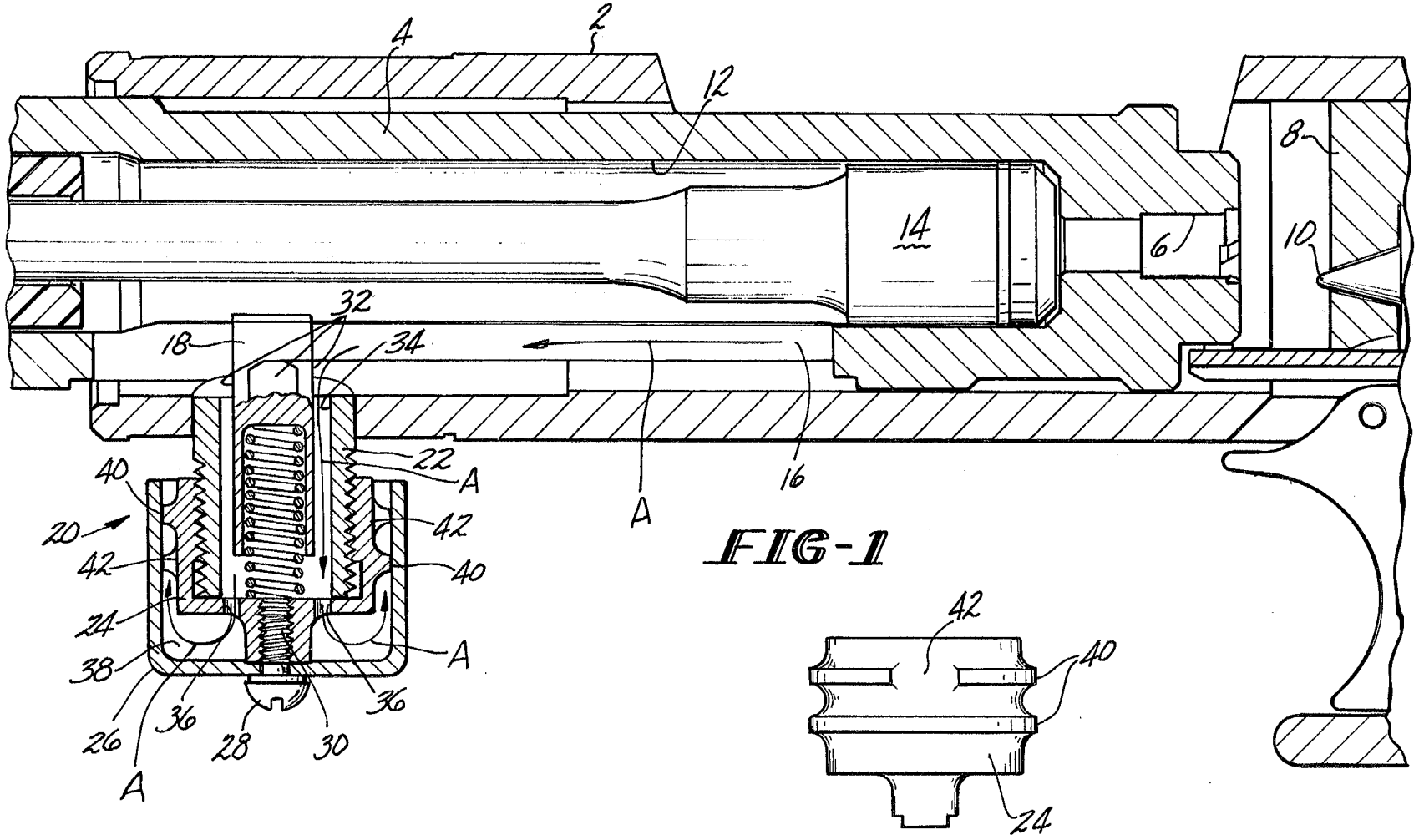

This invention relates to a mechanism for venting fouled combustion gases from the barrel bore of a powder actuated fastening tool to the atmosphere.

A commom problem with powder actuated tools, particularly those which utilize a piston or ram to drive a fastener into a supporting surface, relates to the build-up of combustion gas residue inside of the tool with repeated firings. With repeated usage, the residue inherent in the combustion gases produced when a powder charge is fired causes a residue coating to build up inside of the tool whereby dimensional changes occur with the ultimate result being that the tool will not properly function until it is thoroughly cleaned to remove the accumulated residue.

Most piston or ram-type powder actuated tools presently in use utilize the piston-return mechanism shown in U.S. Pat. No. 3,066,302. This return mechanism includes a slot extending longitudinally of the tool barrel, into which slot there extends a pawl which engages the piston to return the latter from a fired to a firing position. The piston return movement is caused by the occurrence of a relative sliding movement between the barrel and the pawl whereby the pawl traverses the slot. Since the slot is relatively large, high velocity combustion gases escape from the barrel bore through the slot and seek the path of least resistance through the clearances provided between the outer diameter of the barrel and the inner diameter of the barrel housing. After repeated usage, the residue buildup reduces clearances so that the parts will no longer slide with respect to each other resulting in an inability to return the piston to its firing position.

Prior art gas venting systems are shown in U.S. Pat. Nos. 3,172,120; and 3,469,757.

It is the intention of this invention to provide a path of lesser resistance for the combustion gases to flow along so that residue deposits on the barrel and housing are minimized thereby prolonging the useful time period of the tool between cleanings. In order to provide such a path of lesser resistance, a large clearance space is formed between the piston-return pawl and its housing by forming flats on the pawl. With provision of such a large flow path clearance, the high velocity combustion gases are channeled forward through the barrel slot until the gases impinge upon the pawl. The gases are then directed past the pawl flats and into the confines of the pawl housing. The pawl housing is formed with an inner housing part and an outer housing part which are interconnected by means of ports in the inner housing part. The outer housing part is provided with gas vents which are open to the ambient atmosphere. Between the ports and vents there are disposed baffles which retard gas flow velocity and provide for cooling of the combustion gases by means of greater surface area for heat exchange purposes. The combustion gases enter the inner housing and pass therefrom through the ports into the outer housing. The gases then flow through the baffles and pass through the vents into the ambient atmosphere.

It is, therefore, an object of this invention to provide an improved powder actuated piston-type fastener driving tool which has provisions for controlled venting of combustion gases whereby fouling of the moving parts of the tool is materially reduced.

It is a further object of this invention to provide an improved tool of the character described wherein controlled venting of combustion gases is accomplished with minimal structural modification of a conventional tool.

It is another object of this invention to provide an improved tool of the character described wherein the gas venting passages are provided within the housing in which the piston return pawl is disposed.

These and other objects and advantages of this invention will become more readily apparent from the following detailed description of a preferred embodiment of a tool made in accordance with the invention when taken in conjunction with the accompanying drawings, in which:

FIG. 1 is a side sectional view of a portion of a preferred embodiment of a tool formed in accordance with this invention; and FIG. 2 is a side elevational view of the pawl housing cap portion of the tool of FIG. 1.

Referring now to the drawings, there is shown in FIG. 1 a preferred embodiment of a piston-type powder actuated fastener driving tool formed in accordance with this invention. The tool includes an outer housing part 2 in which there is slidably mounted a barrel 4. The breech end of the barrel 4 is provided with a cartridge chamber 6 in which the power load used to operate the tool is disposed for firing. A breech block 8 is disposed in the housing 2, as is the cartridge firing pin 10. Conventional cocking and firing mechanisms (not shown) may be used to cock and fire the tool. Within the barrel 4 there is provided a bore 12 in which there is slidably mounted a piston 14. A longitudinally extending slot 16 is provided in the barrel 4, the slot 16 communicating with the barrel bore 12. A piston return pawl 18 is mounted in a pawl housing denoted generally by the numeral 20, the pawl 18 extending into the slot 16, and the pawl housing 20 being mounted on the outer housing part 2 of the tool. It will be understood that the pawl 18 operates to return the piston 14 from its fired position to its firing position generally in accordance with the teachings of U.S. Pat. No. 3,066,302.

The pawl housing 20 comprises an inner annular sleeve 22 which is secured to the outer housing part 2 of the tool, as by welding, or the like. Screwed onto the sleeve 22 is a cap 24, onto which, in turn, there is secured a shroud 26. The shroud 26 is mounted on the cap 24 by means of a bolt 28 which is threaded into a passage 30 in the cap 24. The pawl is provided with four flats 32, 90° offset from each other so as to provide enlarged clearance between the exterior of the pawl 18 and the bore 34 of the sleeve 22. This clearance provides the flow path whereby the combustion gases pass from the slot 16 into the pawl housing 20. A plurality of holes 36 are provided in the tranverse wall of the cap 24 so as to provide for fluid communication between the sleeve bore 34 and the inside 38 of the shroud 26. In this manner combustion gases can flow from the sleeve bore 34, through the holes 36 to the inside chamber 38 of the shroud 26. Arranged circumferentially around the outer surface of the pawl cap 24 are a pair of projecting ribs 40 which form substantially sealed interfaces with the inner surface of the shroud 26. Longitudinal slots 42 are cut through the ribs 40 so as to provide gas passages from the inside 38 of the shroud 26 to the atmosphere. It will be noted that the slot 42 on one rib 40 is offset by an angle of 180° from the slot 42 on the other rib 40. In this manner the combustion gases will be decelerated and cooled by the tortuous flow path and by contact with the surface of the cap 24 and shroud 26, which act as heat exchanges for the hot gases. It will be readily understood that the cap 24, ribs 40 and shroud 26 serve as a baffle in the gas flow path which decelerates and cools the gases prior to their venting to the atmosphere.

The general flow path taken by the gases from the barrel bore 12 to the atmosphere is shown by the arrows A in FIG. 1.

It will be readily appreciated that the controlled venting of combustion gases which has been described above will reduce fouling residue buildup within the moving parts of the tool thereby increasing the useful life of the tool between cleanings. The venting system of this invention makes use of existing tool structure, and does not require the addition of bulky and heavy housings or the like which increase the weight of the tool and make operation more difficult.

Since many changes and variations of the disclosed embodiment of the invention may be made without departing from the inventive concept, it is not intended to limit the invention otherwise than as required by the appended claims.

What is claimed is:

1. In a powder-actuated tool of the type having a housing; a barrel connected to said housing, said barrel having a bore; a fastener-driving piston slidably mounted in said barrel bore; a slot extending through said barrel and opening into said barrel bore; and a pawl extending through said slot for traversing movement through said slot for returning said piston from a fired position to a firing position, an improved venting system for venting combustion gases from said barrel bore to the atmosphere, said venting system comprising:

(a) a pawl housing secured to said housing, said pawl housing containing said pawl;

(b) means forming a first bore in said pawl housing about said pawl;

(c) means providing an enlarged clearance between said pawl and said slot and opening into said first bore whereby combustion gases are caused to flow from said barrel bore, through said slot and into said first bore;

(d) means forming a second bore in said pawl housing, said second bore being vented to the ambient atmosphere;

(e) means providing fluid communication between said first bore and said second bore whereby combustion gases expelled into said first bore will flow therefrom into said second bore; and (f) baffle means disposed in at least one of said first and second bores for cooling combustion gases flowing therethrough.

2. In a powder-actuated tool of the type having a housing; a barrel connected to said housing, said barrel having a bore; a fastener-driving piston slidably mounted in said barrel bore; a slot extending through said barrel and opening into said barrel bore; and a pawl extending through said slot for traversing movement through said slot for returning said piston from a fired position to a firing position, an improved venting system for venting combustion gases from said barrel bore to the atmosphere, said venting system comprising:

(a) a sleeve secured to said housing, said sleeve having a first bore containing said pawl, said first bore opening into said slot whereby combustion gases will flow from said barrel bore through said slot and into said first bore;

(b) a cap mounted on said sleeve, said cap having an end portion thereof extending across one end of said first bore, and said end portion of said cap being provided with gas flow passages for combustion gas flow therethrough;

(c) a shroud mounted on said cap, said shroud combining with said cap to form a chamber into which said gas flow passages open; and (d) venting means communicating with said chamber for venting combustion gases therefrom into the atmosphere.

3. The device of claim 2, further comprising baffle means in said chamber for cooling combustion gases flowing from said chamber to the atmosphere.

* * * * *